United States Patent [19]

Yanagihara et al.

[11] Patent Number: 4,835,133

[45] Date of Patent: May 30, 1989

[54] RECORDING MATERIAL

[75] Inventors: Naoto Yanagihara; Kensuke Ikeda; Masato Satomura; Yuichi Wakata; Ken Iwakura, all of Shizuoka, Japan

[73] Assignee: Fuji Photo Film Co., Ltd., Kanagawa, Japan

[21] Appl. No.: 162,931

[22] Filed: Mar. 2, 1988

[30] Foreign Application Priority Data

Mar. 2, 1987 [JP] Japan ..... 62-47223

[51] Int. Cl.[4] ..... B41M 5/16; B41M 5/18; B41M 5/22

[52] U.S. Cl. ..... 503/210; 427/150; 427/151; 428/342; 428/913; 428/914; 503/216; 503/225

[58] Field of Search ..... 427/150–152; 428/195, 913, 914, 342; 503/211, 216, 217, 225, 209, 210

[56] References Cited

U.S. PATENT DOCUMENTS 4,012,292 3/1977 Fujiwara et al. ..... 503/200

FOREIGN PATENT DOCUMENTS 53-62532 5/1978 Japan ..... 503/210

*Primary Examiner*—Bruce H. Hess

*Attorney, Agent, or Firm*—Sughrue, Mion, Zinn, Macpeak & Seas

[57] ABSTRACT

A recording material is described comprising an electron-donating colorless dye and a molybdic acid derivative as a color developer; the material has excellent color developability and shelf life stability, and enables the production of a developed color image with excellent fastness and chemical resistance.

9 Claims, No Drawings

RECORDING MATERIAL

FIELD OF THE INVENTION

The present invention relates to a recording material, and, more particularly, to a recording material excellent in color developability, shelf life stability, and stability and chemical resistance of the developed color image.

BACKGROUND OF THE INVENTION

Recording materials which utilize electron-donating dye precursors (color former) and electron-accepting compounds (color developer) are well known for use as pressure-sensitive recording paper, heat-sensitive paper, photo- and pressure-sensitive recording paper, electric heat-sensitive recording paper, and the like.

Such recording materials are described in detail, e.g., in British Pat. No. 2,140,449, U.S. Pat. Nos. 4,480,052 and 4,436,920, Japanese Patent Publication No. 23922/85, Japanese Patent Application (OPI) Nos. 179836/82, 123556/85 and 123557/85 (the term "OPI" as used herein refers to "published unexamined Japanese patent application"), and so on.

A recording material should have properties of (1) producing developed color image of sufficiently high density at a satisfactory speed, (2) generating no fog, (3) ensuring sufficient fastness to the developed color image it produces, (4) ensuring an appropriate hue to the developed color image it produces, (5) having an aptitude for copying apparatuses, (6) having a high signal to noise ratio (S/N ratio), (7) ensuring sufficient chemical resistance to the developed color image it produces, and so on. However, recording materials which meet perfectly all of these essential properties have not yet been obtained.

In particular, heat-sensitive recording materials have made remarkable progress in recent years. However, they have defects such as that they generate fog by contact with solvents or the like, and the developed color images they produce cause discoloration or decolorization upon contact with fats and oils, chemicals, finger tips, and so on. Accordingly, color development occurs in white background areas, or discoloration or decoloration occurs in developed color image areas when a conventional heat-sensitive recording material happens to come into contact with stationary writing materials or office supplies, such as a water-base ink pen, an oil-base ink pen, a fluorescent pen, vermilion inkpad, adhesives, paste, a diazo developer, etc., or cosmetics such as hand cream, milky lotion, etc., which can cause significant damage to the commodity value. There has recently been a striking growth in the demand of heat-sensitive recording materials for use as POS labels, and the market demand for heat-sensitive recording materials having chemical resistance is increasing considerably.

SUMMARY OF THE INVENTION

Therefore, an object of the present invention is to provide a recording material which has satisfactory color developability and shelf life stability, produces a developed color image excellent in fastness and chemical resistance, including water resistance, alcohol resistance and so on, and is made up using constituent materials satisfying other essential properties also.

We have conducted extensive research regarding electron-donating dye precursors and electron-accepting compounds to function as desirable constituent materials of a recording material, and regarding the recording material using such constituents, while taking note of their respective solubilities in oils and in water, partition coefficients and pKa values, polarities and positions of substituent groups they have respectively, crystallinity and solubility changes caused by using them as a mixture, and other characteristics.

As a result, the above-described object has now been attained in accordance with this invention by a recording material comprising an electron-donating colorless dye and a molybdic acid derivative as a color developer.

DETAILED DESCRIPTION OF THE INVENTION

Of the electron-accepting compounds utilized in the present invention, hexavalent molybdenum compounds are preferred over others.

More particularly, complex salts prepared from a hexavalent molybdemum atom and organic ligands containing oxygen atoms, sulfur atoms, or nitrogen atoms, such as $\beta$-diketone compounds, $\beta$-keto ester compounds, imidazole compounds, antipyridine compounds, dioxy compounds, dimercapto compounds, etc., are advantageous, because colors developed thereby have respective absorption bands which are significantly shifted to longer wavelengths.

Specific examples of such $\beta$-diketone compounds and other include acetylacetone, benzoyltrifluoroacetone, dipivaloylmethane, furoyltrifluoroacetone, dibenzoylmethane, hexafluoroacetylacetone, $\alpha$-acetylacetylacetone, heptafluorobutanoylpivaloylmethane, phenylacetylacetone, naphthoylacetylacetone, p-t-amylphenylacetylacetone, pivaloyltrifluoroacetone, trifluoroacetylacetone, trioctylophosphine oxide, thenoyltrifluoroacetone, thenoylbenzoylmethane, ethyl acetoacetate, butyl methylacetoacetate, antipyrine, dimethylpyridine, and so on.

Compounds which can be particularly preferably used in the present invention are represented by formula (I)

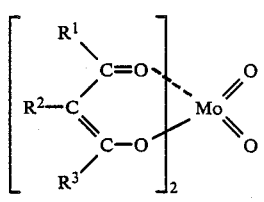

(I)

wherein $R^1$ and $R^3$ each represents a hydogen atom, an alkyl group (preferably $C_1$ to $C_{20}$, more preferably $C_1$ to $C_{10}$), an aromatic ring (preferably $C_4$ to $C_{20}$, more preferably $C_4$ to $C_{12}$), or an alkoxy group; $R^2$ represents a hydrogen atom, or a lower alkyl group (preferably $C_1$ to $C_8$, more preferably $C_1$ to $C_5$); $R^1$ and $R^2$, or $R^2$ and $R^3$, together may form a ring.

In formula (I), alkyl groups represented by $R^1$ and $R^3$ may be substituted with a halogen atom, an alkyl group, an alkoxy group or so on, and the aromatic ring may contain a hetero atom, and may be substituted with a halogen atom, an alkyl group, an alkoxy group, etc.

Specifically, preferred examples of groups represented by $R^1$ and $R^3$ include —H, $—CH_3$, $—C_2H_5$, $—C_4H_9$, $—C_8H_{17}$, $—CF_3$,

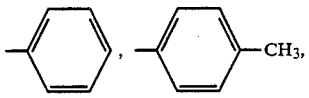

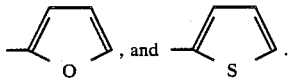

Solubilities of the electron-accepting compounds used in accordance with the present invention in ethanol at 25° C., are preferably 50 or less, and particularly preferably 15 or less. The term solubility used in the present invention refers to the mass (gram) of a solute dissolved in 100 g of ethanol at 25° C.

Specific examples of electron-accepting compounds in accordance with the present invention are illustrated below. However, the invention is not to be construed as being limited to these compounds.

(1)

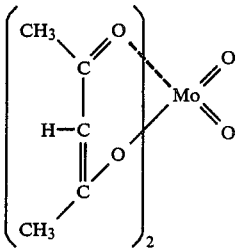

(2)

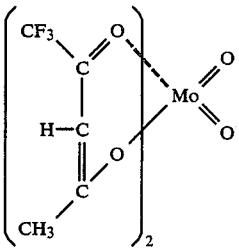

(3)

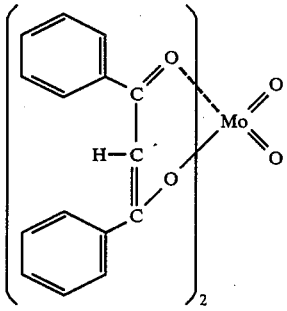

(4)

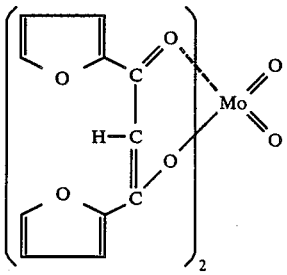

-continued (5)

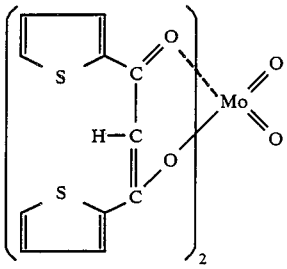

(6)

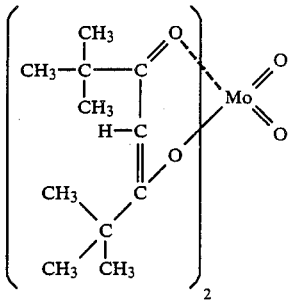

(7)

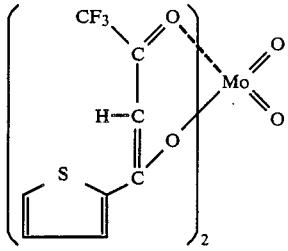

(8)

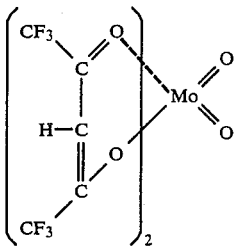

The molybdic acid derivatives used as a color developer in the present invention can be produced by applying various synthetic method as described, for example, in *Inorganic Chemistry,* Vol. 5, page 801 (1966) and vol. 7, page 2510 (1968). Typical examples of applicable production processes are given below.

(Ia)

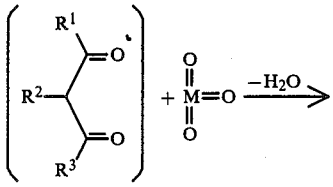

-continued

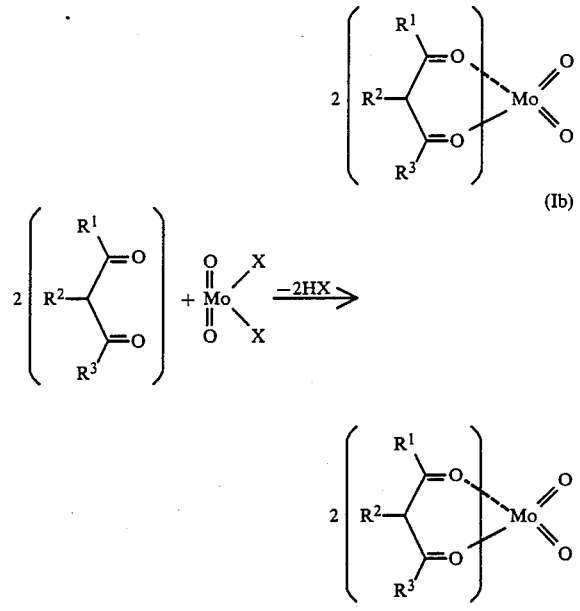

(Ib)

In the above formulae (Ia) and (Ib), X represents Cl and Br.

The electron-accepting compounds in accordance with the present invention may be used alone or may be used as a mixture thereof. Further, the electron-accepting compounds may be used as a mixture with a phenolic compound, a salicyclic acid derivative or a metal salt thereof, a bis-2-hydroxyphenylsulfonic acid derivative, a metal salt thereof, or complex salts of zinc rhodanide.

Examples of phenolic compounds which can be used include 4-phenylphenol, bisphenol sulfone, p-phenylsulfonylphenol, p-tolylsulfonylphenol, bis(3-vinyl-4-hydroxyphenyl)sulfone, 2,2-bis(3-vinyl-4-hydroxyphenyl)-propane, bis-3-allyl-4-hydroxyphenylsulfone, hexyl-4-hydroxybenzoate, 2,2'-dihydroxybiphenyl, 2,2-bis(4-hydroxyphenyl)-propane, 4,4'-isopylidenebis(2-methylphenol), 1,1-bis-(3-chloro-4-hydroxyphenyl)cyclohexane, 1,1-bis(3-chloro-4-hydroxyphenyl)-2-ethylbutane, 4,4'-sec-butylidenediphenol, 4-p-methylphenylphenol, 4,4'-isopentylidenediphenol, 4,4'-methylcyclohexylidenediphenol, 4,4'-dihydroxydiphenylsulfide, 1,4-bis(4'-hydxycumyl)benzene, 1,3-bis(4'-hydroxycumyl)benzene, 4,4'-thiobis(6-tert-butyl-3-methylphenol), 4,4'-dihydroxydiphenylsufone, hydroquinone monobenzyl ether, 4-hydroxybenzophenone, 2,4-dihydroxybenzophenone, polyvinylbenzyloxycarbonylphenol, 2,4,4'-trihydroxybenzophenone, 2,2',4,4'-tetrahydroxybenzophenone, dimethyl 4-hydroxyphthalate, methyl 4-hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, α-phenylbenzyl-4-hydroxybenzoate, phenylpropyl 4-hydroxybenzoate, phenetyl 4-hydroxybenzoate, p-chlorobenzyl 4-hydroxybenzoate, p-methoxybenzyl 4-hydroxybenzoate, benzyl 4-hydroxybenzoate, m-chlorobenzyl 4-hydroxybenzoate, β-phenetyl 4-hydroxybenzoate, 4-hydroxy-2',4'-dimethyldiphenylsulfone, β-phenetylorsellinate, cinnamyl orsellinate, o-chlorphenoxyethyl orsellinate, o-ethylphenoxyethyl orsellinate, o-phenylphenoxyethyl orsellinate, m-phenylphenoxyethyl orsellinate, β-3'-t-butyl-4'-hydroxyphenoxyethyl 2,4-dihydroxybenzoate, 1-t-butyl-4-p-hydroxyphenylsulfonyloxybenzene, 4-N-benzylsulfamoylphenol, p-methylbenzyl 2,4-dihydroxybenzoate, β-phenoxyethyl, 2,4-dihydroxybenzoate, benzyl 2,4-dihydroxy-6-methylbenzoate, methyl bis-4-hydroxyphenylacetate, and so on.

Examples of salicyclic acid derivatives which can be used in the present invention include acids and salts thereof 4-pentadecylsalicylic acid, 3-phenylsalicylic acid, 3-cyclohexylsalicylic acid, 3,5-di-t-butylsalicylic acid, 3,5-di-dodecylsalicylic acid, 3-methyl-5-benzylsalicylic acid, 3-phenyl-5-(α,α-dimethylbenzyl)-salicylic acid, 3,5-di-(α-methylbenzyl)salicylic acid, 3,5-di-t-octylsalicylic acid, 5-tetradecylsalicylic acid, 5-hexadecylsalicylic acid, 5-octadecylsalicylic acid, 5-α-(p-α-methylbenylphenyl)ethylsalicylic acid, 4-dodecyloxysalicylic acid, 4-tetradecyloxysalicylic acid, 4-hexadecyloxysalicylic acid, 4-β-phenoxyethoxysalicylic acid, 4-β-p-tolyloxyethoxysalicylic acid, 4-β-p-ethylphenoxyethoxysalicylic acid, 4-β-p-methoxyphenoxyethoxysalicylic acid, 4-β-p-ethoxyphenoxyethoxysalicylic acid, 4-β-m-tolyloxyethoxysalicylic acid, 4-β-o-tolyloxyethoxysalicylic acid, 4-(8-phenoxyoctyloxy)-salicylic acid, and so on. Metals to form the salts of these salicylic acids include zinc, aluminum, magnesium and calcium.

Examples of metal salts of bis(2-hydroxyphenyl)-sulfones which can be used include those prepared from zinc, nickel, magnesium or like metals and bis(2-hydroxy-5-butylphenyl)sulfone, bis(2-hydroxy-5-phenylphenyl)-sulfone, bis(2-hydroxy-5-octylphenyl)-sulfone, bis(2-hydroxy-5-chlorophenyl)sulfone, bis(2-hydroxy-3-chloro-5-butylphenyl)sulfone, etc.

Examples of complex salts of zinc rhodanide which can be used include those prepared from zinc rhodanide and imidazole, 2-phenylimidazole, picoline, pyridine, 2-benzylimidazole, benzoimidazole, 2,3-dimethyl-1-phenyl-3-pyrazoline-5-one, 1-phenyl-2-methyl-3-benzyl-3-pyrazoline-5-one, 1-phenyl-2-methyl-3-(2-ethylhexyl)-3-pyrazoline-5-one, 1-phenyl-2-methyl-3-isopropyl-3-pyrazoline-5-one, 1-phenyl-2,3-benzyl-pyrazoline-5-one, 1-phenyl-2-benzyl-3-methyl-pyrazoline-5-one, 4,4'-diantipyrylmethane, and so on.

The electron-accepting compounds in accordance with the present invention are preferably used in an amount of about 0.1 to 2 g/m$^2$.

Colorless dyes (color former) used in the present invention have already been well-known. To illustrate by citing several instances from among various kinds of known colorless dyes, specific examples of phthalides are described in U.S. Pat. No. Re. 23,024, U.S. Pat. Nos. 3,491,111, 3,491,112, 3,491,116, and 3,509,174; examples of fluorans are described in U.S. Pat. Nos. 3,624,107, 3,627,787, 3,641,011, 3,462,828, 3,681,390, 3,920,510, and 3,959,571; examples of spirodipyrans as described in U.S. Pat. No. 3,971,808; examples of color forming compounds of pyridine and pyrazine types are described in U.S. Pat. Nos. 3,775,424, 3,853,869, and 4,246,318; examples of fluorene compounds are described in Japanese Patent Application No. 240989/86 filed on Oct. 9, 1986; and so on.

More specifically, examples of triarylmethane compounds include 3,3-bis(p-dimethylaminophenyl)-6-dimethylaminophthalide, 3,3-bis(p-dimethylaminophenyl)-phthalide, 3-(p-dimethylaminophenyl)-3-(1,3-dimethylindole-3-yl)phthalide, 3-(p-dimethylaminophenyl)-3-(2-methylindole-3-yl)phthalide, and the like. As for the diphenylmethane compounds, 4,4'-bis-dimethylaminobenzhydrine benzyl ether, N-halophenylleucoauramine, N-2,4,5-trichlorophenyl-leucoauramine and the like.

Examples of xanthene compounds include Rhodamine-B-anilino-lactam, Rhodamine (p-nitroanilino)lactam, Rhodamine B (p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dichloroanilino)-6-diethylaminofluoran, 3-p-anilinoanilino-6-methylfluoran, 3-p,p'-anilinoanilino-6-chloro-7-methylfluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phenyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-N-isoamylaminofluroan, 2-o-chloroanilino-6-p-butylaminolinofluoran, 2-anilino-3-pentadecyl-6-diethylaminofluoran, 2-anilino-3-ethyl-6-dibutylaminofluoran, 2-anilino-3-ethyl-6-N-ethyl-6-N-ethyl-N-isoamylaminofluoran, 2-anilino-3-methyl-6-N-ethyl-N-γ-methoxypropylaminofluoran, 2-anilino-3-chloro-6-N-ethyl-N-isoamylaminofluoran, and the like.

As for the thiazine compounds, examples include benzoyl Leuco Methylene Blue, p-nitrobenzyl Leuco Methylene Blue, and the like.

Examples of spiro compounds include 3-methylspiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)spiropyran, 3-propyl-spiro-dibenzopyran and the like.

Examples of fluorene compounds include 3',6'-bisdiethylamino-5-diethylaminospiro(isobenzofuran-1,9'-fluorene)-3'-one, 3',6'-bisdimethylamino-5-dibutylaminospiro(isobenzofuran-1,9'-fluorene)-3'-one, 3',6'-bisdibutylamino-5-diethylaminospiro(isobenzofuran-1,9'-fluorene)-3'-one, 3',6'-bis-N-ethyl-N-isoamylaminospiro)isobenzofuran-1,9'-diphenoxyethylamino-5-fluorene)-3'-one and the like.

Of the foregoing colorless dyes, those capable of showing a black hue when used alone or as a mixture of two thereof are favored over others.

In producing heat-sensitive paper, an electron-donating colorless dye and an electron-accepting compound are used in such a condition that they are ground in a dispersing medium to fine particles generally measuring 10 microns or less, and preferably 3 microns or less, in diameter. As the dispersing medium, an aqueous solution containing a water-soluble high polymer in a concentration of about 0.5 to 10 wt% is generally employed, and the dispersion procedure is performed using a ball mill, a sand mill, a horizontal type sand mill, an attritor, a colloid mill, and so on.

A preferred weight ratio of the electron-donating colorless dye used to the electron-accepting compound used ranges from 1/10 to 1/1, and particularly preferably from 1/5 to 2/3. Independently of the electron-donating colorless dye and the electron-accepting compound, calcium carbonate and/or zinc oxide are typically ground in a dispersing medium to prepare a dispersion. A preferred amount of calcium carbonate used and/or zinc oxide used is 0.5 to 20 times (by weight), particularly 1 to 10 times (by weight), that of the electron-accepting compound used. In addition, the heat-sensitive color developing layer can contain a heat fusible substance in order to enhance its heat-responsiveness.

As suitable examples of a compound which is at least one constituent of a heat fusible substance which can be preferably used, ethers derived from aromatic alcohols are cited.

More specifically, ethers derived from phenols, naphthols, thiophenols or thionaphthols, each of which is substituted with a group containing not more than 8 carbon atoms, e.g., hydrogen atom, an alkyl group, an allyl group, an aryl group, an acyl group, a halogen atom, an alkoxy group, an alkylthio group, a cyano group, an alkoxycarbonyl group, a hydroxy group, or so on, are used to advantage.

Such ethers are represented by formula (II)

$$Ar—X—R_1 \quad (II)$$

wherein Ar represents an aromatic ring, X represents —O— or —S—, and $R_1$ represents an alkyl group which may be substituted. The aromatic ring represented by Ar may have one or more of the above-cited substitutent groups, and the substituent groups may combine with each other to form a 5- to 7-membered ring which may contain a hetero atom.

Other constituent of the heat fusible substance is selected from among aromatic ethers, esters, acid amides and ureas.

The acid amides and the ureas include compounds derived from aliphatic or aromatic carboxylic acids or sulfonic acids.

Such compounds are represented by the following general formulae (III A) and (III B)

$$R_2YNHR_3 \quad (III\ A)$$

$$R_2YOR_3 \quad (III\ B)$$

In the formulae (III A) and (III B), $R_2$ and $R_3$ each represents a hydrogen atom, or an alkyl or aryl group which may be substituted with one or more of a substituent selected from halogen atoms, alkoxy groups, alkyl groups, aryl groups, aryloxy groups, hydroxy group, acyl groups, alkoxycarbonyl groups, substituted amino groups, carbamoyl groups, and sulfamoyl groups. Of the foregoing compounds, those containing as at least either $R_2$ or $R_3$ a moiety having an aromatic ring or a long-chain alkyl group are favored over others. Y represents —CO— or —$SO_2$—.

As examples of compounds represented by formula (II), (III A) or (III B), mention may be made of phenoxyethyl biphenyl ether, phenetyl biphenyl, benzyloxynaphthalene, benzyl biphenyl, di-m-tolyloxyethane, β-phenoxyethoxyanisole, 1-phenoxy-2-p-ethylphenoxyethane, bis-β-(p-methoxyphenoxy)-ethoxymethane, 1-2'-methylphenoxy-2-4''-ethylphenoxyethane, 1-tolyloxy-2-p-methylphenoxyethane, 1,2-difluorophenoxyethane, 1,4-diphenoxybutane, bis-β-(p-methoxyphenoxy)-ethyl ether, 1-phenoxy-2-p-chlorophenoxyethane, 1-2'-methylphenoxy-2-4''-ethyloxyphenoxyethane, 1-4'-methylphenoxy-2-4''-fluorophenoxyethane, 1-phenoxy-2-p-methoxyphenyl thioether, 1,2-bis-p-methoxyphenyl thioether, 1-tolyloxy-2-p-methoxyphenyl thioether, 1,3-bis-p-tolyloxypropane, 1,3-bis-p-chlorophenoxypropane, 1,1,3-trisphenoxyhexane, 1,4-bis-p-tolyloxybutane, 1,4-bis-p-chlorophenoxybutane, 1,2-bisphenoxyethane, 1,2-bis-p-tolyloxyethane, 1,2-bis-p-chlorophenoxyethane, 1,2-bis-p-methoxyphenoxyethane, 1,4-bis-α-naphthyloxybutane, 1,6-bis-phenoxyhexane, 1,3-bisphenoxy-2-benzyloxypropane, bis-(2-p-tolyloxyethyl) ether, 1,1,3-tris-phenoxybutane, bis-(β-3,5-dimethylphenoxyethyl) ether, bis-(β-4-benzyloxycarbonylphenoxyethyl) ether, 1-phenoxy-2-p-ethylphenoxyethane, bis-(2-β-naphthyloxyethyl) ether, 1,2-bis-[2-(p-tolyloxy)ethoxy]ethane, 1,2-bis[2-(3,5-dimethylphenoxy)ethoxy]ethane, 1-phenoxy-2-p-chloropnenyloxyethane, 1,2-bis(2-β-naphthyloxyethoxy)ethane, bis(2-p-tolyloxyethoxy)methane, bis[2-(2,4,6-trimethylphenoxy)ethoxy]methane, 1-phenoxy-2-β-naphthyloxypropane, bis(2-β-naphthyloxyethoxy)methane, bisphenoxymethyl sulfide, bis(2-phenoxyethyl) sulfide, 1,3-bisphenoxymethylbenzene, 1,2-bisphenoxymethylbenzene, bisphenoxymethyl ether, 1-phenoxy-2-p-ethylthiophenxoyethane, 1,3,5-trisphenoxyethoxybenzene, 1-phenoxy-2-p-tolyloxyethane, 1-phenoxy-2-β-naphthyloxypropane, 1-p-tolyloxy-2-p-chlorophenoxyethane, 1,3-diphenoxy-2-propanol, 4-(2-phenoxyethoxy)-benzoic acid methyl ester, 1,2-bis(-phenylthio)ethane, 1,2-bis(4-methoxyphenylthio)ethane, 1,2-bis(3-methoxyphenylthio)ethane, 1,2-bis(4-methylphenylthio)ethane, 1,2-bis-(2-methylphenylthio)ethane, 1,2-bis(4-methylphenylthio)-propane, 1-(4-methylphenylthio)-2-(4-methoxyphenylthio)-ethane, 1,4-bis(4-methoxyphenylthio)butane, 1,6-bis(4-methylphenylthio)hexane, 1,5-bis-β-naphthoxy-3-thioooxapentane, bis[2'-(4-methoxyphenylthio)ethyl] sulfide, bis[2-(4-methylphenylthio)ethyl]ether, 2,2'-bis[2-(phenylthio)-ethyl]-diethyl sulfide, 1,2-bis(2-naphthylthio)-ethane, stearic acid amide, stearic acid anilide, stearic acid p-anisilide, stearic acid o-anisilide, ethylenebisstearoamide, methylolstearoamide, phenylacetic acid amide, phenoxyacetic acid amide, p-methoxyphenoxyacetic acid amide, phenoxypropionic acid amide, phenoxyacetic acid anilide, phenoxybutyric acid amide, phenylpropionic acid amide, phenoxyacetic acid benzylamide, phenoxyacetic acid phenetylamide, 2-ethylhexanoic acid anilide, stearylurea, hexylurea, N-phenylhexylurea, N-stearyl-N'-phenylurea, 2-phenoxy-1-p-methoxyphenylthioethane, 2-p-tolyloxy-1-p-methoxyphenylthioethane, β-naphthylphenoxyacetate, β-naphthoxyacetic acid phenoxyethyl ester, β-phenoxyethylbenzoylpropionate, p-methoxyphenoxyethyl-p'-methoxyphenoxyacetate, phenoxybenzodioxane, phenoxymethylnaphthodioxane, p-phenylphenol glycidyl ether, phenoxyethyl hydroxynaphthoate, phenyl hydroxynaphthoate, 1,4-dibutoxynaphthalene, benzyl benzyloxybenzoate, phenyl benzoate, methoxycarbonylbenzoic acid amide, dihydroxybenzene diglycidyl ether, 2-(3,4-methylenedioxyphenoxy)-1-p-fluorophenoxyethane, diphenyl carbonate, ditolylcarbonate, benzylnaphthyl carbonate, and so on.

The above-described heat fusible substances may be used alone or as a mixture of two or more thereof. In order to impart sufficient heat-responsiveness, such substances are preferably used in a proportion of from 10 to 200% by weight, and particularly preferably from 20 to 150% by weight, with respect to the electron-accepting compound used.

To a coating composition obtained by mixing the thus prepared dispersions in an appropriate ratio, certain additives can further be used in order to satisfy various requirements.

For example, an oil absorbing substance, such as an inorganic pigment, polyurea filler, etc., can be dispersed in advance in a binder for the purpose of preventing a recording head from being stained upon recording. In addition, fatty acids, metallic soaps and the like can be added for the purpose of enhancing the facility in releasing a heat-sensitive paper from a recording head. In general, not only the components responsible for color development, i.e., colorless dyes and electron-accepting compound, but also additives including a pigment, waxes, an antistatic agent, an ultraviolet absorbent, a defoaming agent, a conductive agent, fluorescent dyes, a surface active agent, hindered phenols, benzoic acid derivatives, and so on can be coated on a support to constitue the recording material.

More specifically, pigment added typically has a particle size ranging from 0.1 to 15 microns and is selected from among kaolin, calcined kaolin, talc, diatomaceous earth, aluminium hydroxide, magnesium hydroxide, calcined gypsum, silica, magnesium carbonate, titanium oxide, alumina, barium carbonate, barium sulfate, mica, glass microballoons, urea-formaldehyde filler, polyethylene particles, cellulose filler, and so on.

Examples of the waxes include paraffin wax, carboxy-denatured paraffin wax, carnauba wax, microcrystalline wax, polyethylene wax, higher fatty acid esters, and so on.

Examples of the metallic soaps include polyvalent metal salts of higher fatty acids such as zinc stearate, aluminum stearate, calcium stearate, zinc oleate, and so on.

Examples of favored hindered phenols include phenol derivatives having a branched alkyl substituent at least at the 2-position or the 6-position.

For example, 1,1-bis(2-methyl-4-hydroxy-5-t-butylphenyl)butane, 1,1,3-tris(3-methyl-4-hydroxy-5-t-butylphenylbutane, bis(2-hydroxy-3-t-butyl-5-methylphenyl)-methane, bis(2-methyl-4-hydroxy-5-t-butylphenyl)sulfide, and so on can be cited.

These additives are dispersed into a binder, and coated.

Examples of favored benzoic acid derivatives include metal salts of benzoic acids containing one or more of an electron-attracting group. Specific examples of such salts include zinc, aluminum, cadmium, magnesium calcium and like salts of halogen-substituted benzoic acids, nitrobenzoic acid, cyanobenzoic acid, substituted sulfonyl benzoic acids, acylbenzoic acid, substituted carbamoyl benzoic acids, alkoxycarbonylbenzoic acids, substituted sulfamoyl benzoic acids and the like. Of these salts, the zinc salts are preferred over others. These salts can also be used a an electron-accepting compound. These are dispersed together with or independently of another electron-accepting compound, and coated.

As for the binder, water-soluble binders are generally used. Specific examples thereof include polyvinyl alcohol, hydroxyethyl cellulose, hydroxypropyl cellulose, epichlorohydrin-denatured polyamide, ethylenemaleic anhydride copolymers, styrene-maleic anhydride copolymers, isobutylene-maleic anhydride copolymers, polyacrylic acid, polyacrylamide, methylol-denatured polyacrylamide, starch derivatives, casein, gelatin and so on. To these binders can be added a gelling agent or a cross-linking agent, and an emulsion of a hydrophobic polymer, such as styrene-butadiene rubber latex, aryl resin emulsion, etc., in order to impart water resisting property.

The coating composition is coated on base paper, wood free paper, synthetic paper, plastic sheet or neutralized paper at a coverage of 2 to 10 g/m$^2$.

Further, a protective layer comprising a water-soluble or water-dispersible high polymer, such as polyvinyl alcohol, hydroxyethyl starch or epoxy-denatured polyacrylamide, and a cross-linking agent, and having a thickness of about 0.2 to 24 microns may be provided on the coated layer surface, thereby enhancing resisting properties.

In case of heat-sensitive paper, various embodiments described in German Patent Application (OLS) Nos. 2,228,581 and 2,110,854, Japanese Patent Publication No. 20142/77, and so on can be employed. On the other hand, heat-sensitive paper may be subjected to procedures like preheating, moisture control, stretching of coated paper, and so on.

The present invention is illustrated in greater detail by reference to the following examples. However, the invention is not to be construed as being limited to these examples.

EXAMPLE 1

(1) Preparation of Sample 1:

Two gram of 2-anilino-3-methyl-6-N-ethyl-N-propylaminofluoran and 2 g of 2-anilino-3-chloro-6-diethylaminofluoran were dispersed into separate 25 g portions of a 3.5% aqueous solution of polyvinyl alcohol (saponification degree: 99%, polymerization degree: 1,000) using a sand mill until their respective mean particle size became 2 microns.

Separately, 10 g of 4-$\beta$-p-methoxyphenoxyethoxysalicylic acid and 8 g of $\beta$-benzyloxynaphthalene were dispersed together with a 50 g portion of a 3% aqueous solution of polyvinyl alcohol using a ball mill over a 24-hour period. Further, 8 g of Mo-Compound (1), 10 g of zinc oxide and 15 g of phenylacetylbenzylamide were dispersed together with a 50 g portion of a 3% aqueous solution of polyvinyl alcohol using a ball mill over a 24-hour period. Furthermore, 0.1 g of 1,1,3-tris-2'-methyl-4'-hydroxy-5'-t-butylphenylbutane was dispersed together with a 20 g portion of a 5% aqueous solution of polyvinyl alcohol over a 24-hour period.

The thus prepared dispersions were thoroughly mixed, and thereto was added 15 g of Georgia kaolin and 6 g of finely divided silica, followed by the dispersion procedure. To the resulting dispersion was further added 4 g of a 50 g dispersion of a parafin wax emulsion (Cellosole #428, produced by Chukyo Yushi Co., Ltd.) to prepare a coating composition.

The coating composition was coated on neutralized paper having a basis weight of 45 g/m$^2$ at a coverage of 5.2 g/m$^2$ on a solids basis, dried at 60° C. for one minute, and subjected to a supercalendering process under a linear pressure of 60 Kg W/cm to produce coated paper.

To the coated paper was applied thermal energy of 35 mJ/mm$^2$ using a facsimile machine (FF-2000, produced by Fujitsu Ltd.) to develop a color. A density of the developed color was 0.92 upon measurement with a Macbeth densitometer.

The recording material prepared in the above-described manner did not have fog resulting from storage prior to recording, that is, it had excellent keeping stability. In addition, the developed color image assumed pure black hue, and exhibited excellent resistances to chemicals, water, and sunlight.

EXAMPLE 2

A coating composition was prepared in the same manner as in Example 1, except that Mo-Compound (4) was used in place of Mo-Compound (1). The coating composition was coated on calcium carbonate-coated neutralized paper at a coverage of 6 g/m$^2$, and dried under the same condition as in Example 1. Color development was performed using the same procedure as in Example 1, and thereby was obtained a pure black image with a reflection density of 0.90 or above.

This pure black image caused little discoloration or fading even when touchned with oils and fats, or exposed to sunlight.

EXAMPLE 3

An electron-donating colorless dye constituted with 6 g or 2-N-po-diethylaminophenylanilino-6-N-ethyl-N-isoamylaminofluoran, 8 g of 2-anilino-3-chloro-6-diethylaminofluoran and 2 g of 3',6'-bisdiethylamino-5-diethylaminospiro(isobenzofuran-1,9'-fluorene)-3'-one, 20 g of Mo-Compound (1) as an electron-accepting compound, and a mixture of 10 g of 2-benzyloxynaphthalene and 15 g of stearic acid amide as a heat fusible substance were dispersed together with separate 100 g portions of a 5% aqueous solution of polyvinyl alcohol (PVA 105, produced by Kuraray Co., Ltd.) using a ball mill over a period of one day and night, whereby achieving the volume average particle size of 3 microns. Separately, 80 g of calcium carbonate-zinc oxide 1:1 (by weight) mixture was dispersed together with 160 g of a 0.5% solution of sodium hexametaphosphate using a homogenizer.

The thus prepared dispersions were mixed in such a proportion that the dispersion of the electron-donating colorless dye was used in an amount of 5 g, that of the electron-accepting compound in an amount of 10 g, that of the heat fusible substance in an amount of 5 g, and that of the calcium carbonate-zinc oxide mixture in an amount of 22 g. To the resulting mixture were further added 4 g of an emulsion of zinc stearate and 5 g of a 2% aqueous solution of sodium (2-ethylhexyl)sulfosuccinate to prepare a coating composition.

The coating composition was coated on wood free paper, which had a basis weight of 50 g/m$^2$, at a dry coverage of 6 g/m$^2$ using a wire bar, dried for 5 minutes in a 50° C. oven, and subjected to a calendering procedure to prepare coated paper.

Color-development processing was performed using a high speed facsimile machine (FF-2000, produced by Fujitsu Ltd.) to produce a black image on the coated paper. This developed-color image had a light absorption band in the near infrared region. In addition, when two sheets of filter paper were impregnated with ethanol and caster oil, respectively, and superposed on the color-developed side of the recording paper obtained in the above-described manner, fog in the white area and decoloring (discoloration and fading) in the developed-color area were hardly perceived.

Furthermore, the coated paper was kept for 24 hours under a high temperature condition (60° C., 30% RH), or a high humidity condition (40° C., 90% RH). However, fog was hardly generated by such storage procedures.

EXAMPLE 4

Coated paper was prepared in the same manner as in example 3, except that a mixture of 10 g of Compound (1) and 10 g of 2,3-dimethyl-1-phenyl-3-pyrazoline-5-one complex of zinc rhodanide were used in place of 20 g of Compound (1).

The developed color images each showed the absorption of light in the near infrared region, and fog was hardly generated.

EXAMPLE 5

The efficiencies of the pressure-sensitive recording microcapsule sheet as one embodiment of the present invention were checked using the following developer sheet. All parts are by weight.

Preparation of a developer sheet:

Into 70 parts of water, 2 parts of zinc oxide, 18 parts of calcium carbonate and 4 parts of Mo-Compound (6) were added and mixed, and the mixture was dispersed for 30 minutes by an attritor. Then, 2.5 parts by weight (solids content) of carboxyl modified SBR latex and 12 parts of 10 wt% aqueous solution of polyvinyl alcohol (saponification degree: 99%, polymerization degree: 1000) were added to the dispersion and were homogeneously stirred to obtain a coating solution. The coating solution was coated by an air knife coating device on a base paper of 50 g/m$^2$ so that the coating amount was 4 g/m$^2$ (solids content), and was dried to obtain a developer sheet.

Preparation of a microcapsule sheet

Four parts of 3-(2-ethoxy-4-diethylaminophenol)-3-(1-octyl-2-methylindole-3-yl)phthalide 2 parts of the nickel compound were dissolved in 100 parts of 1-phenyl-1-xylylethane and the resulting color former-containing oil solution was dispersed in 100 parts of 4.4 wt% aqueous solution of partially sodium salt of polyvinylbenzene sulfonic acid (average molecular weight: 500,000) which has a pH value of 6 to obtain o/w (oil-in-water) type emulsion having an average particle size of 4.5 μm.

Separately, 6 parts of melamine, 11 parts of 37 wt% aqueous solution of formaldehyde and 83 parts of water were heated and stirred at 60° C. for 30 minutes to prepare a transparent aqueous solution of a mixture of melamine, formaldehyde, and initially condensed product of melamine and formaldehyde.

The thus prepared aqueous solution was added to the above-described emulsion, and, with stirring, a 20 wt% aqueous solution of acetic acid was added thereto to adjust pH to 6.0. After raising the temperature of the mixture to 65° C., the mixture was allowed to stand for 30 minutes to carry out encapsulation.

Into the microcapsule solution, 200 parts of 20 wt% of aqueous solution of etherified starch, 47 parts of starch particles (an average particle size: 40 μm) and 10 parts of talc were added, and water was further added thereto to adjust the solid concentration to 20 wt% to prepare a coating soluton of microcapsule.

The thus prepared microcapsule solution was coated by an air knife coating device on a base paper (weighing capacity: 40 g/m$^2$) so that dry coating amount was 5 g/m$^2$, and dried to provide a microcapsule sheet.

The obtained microcapsule sheet was superposed on the above developer sheet under a pressure of 300 kg/cm$^2$ to form a coloration. As a result, blue color image was obtained.

While the invention has been described in detail and with reference to specific embodiments thereof, it will be apparent to one skilled in the art that various changes and modifications can be made therein without departing from the spirit and scope thereof.

What is claimed is:

1. A recording material comprising a support having thereon an electron-donating colorless dye and a molybdic acid derivative as a color developer, wherein said molybdic acid derivative is represented by formula (I)

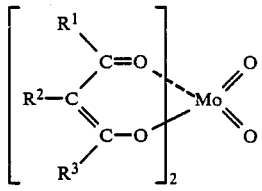

(I)

wherein $R^1$ and $R^3$ each represents a hydrogen atom, an akyl group, an aromatic ring or an alkoxy group; $R^2$ represents a hydrogen atom or lower alkyl group; $R^1$ and $R^2$, or $R^2$ and $R^3$, together may form a ring.

2. A recording material as in claim 1, wherein said molybdic acid derivative has a solubility of 50 or less in ethanol at 25° C.

3. A recording material as in claim 1, wherein said molybdic acid derivative has a solubility of 15 or less in ethanol at 25° C.

4. A recording material as in claim 1, wherein said molybdic acid derivative is a hexavalent Mo compound.

5. A recording material as in claim 1, wherein $R^1$ and $R^3$ are selected from the group consisting of —H, —$CH_3$, —$C_2H_5$, —$C_4H_9$, —$C_8H_{17}$, —$CF_3$,

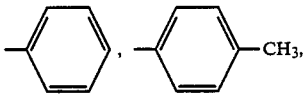

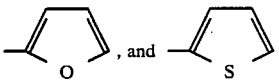

6. A recording material as in claim 1, wherein the compound in accordance with formula (I) is selected from the group consisting of

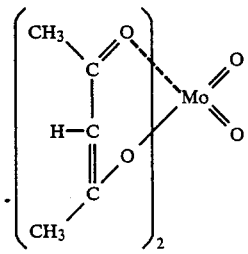

(1)

-continued (2)

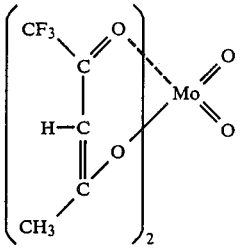

(3)

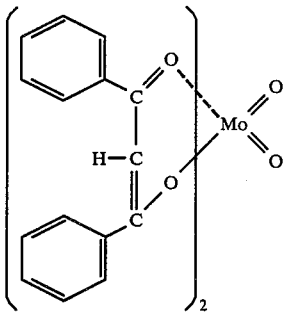

(4)

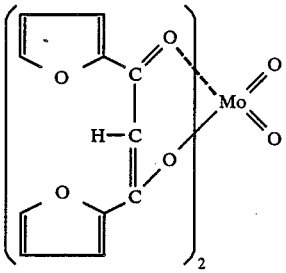

-continued (5)

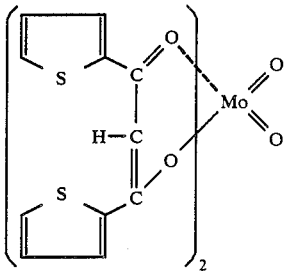

(6)

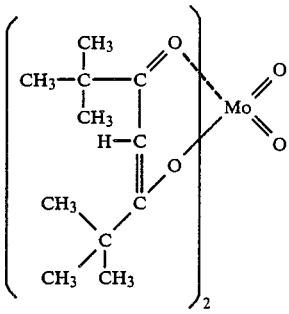

(7)

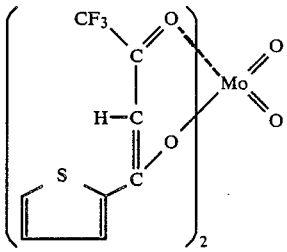

(8)

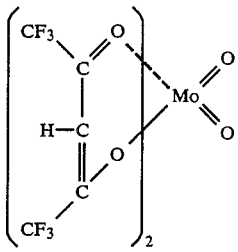

7. A recording material as in claim 1, wherein the weight ratio of the electron-donating dye to the molybdic acid derivative is from 1/10 to 1/1.

8. A recording material as in claim 1, wherein the weight ratio of the electron-donating dye to the molybdic acid derivative is from 1/5 to 2/3.

9. A recording material as in claim 1, wherein said molybdic acid derivative is used in an amount of about 0.1 to 2 g/m$^2$.

* * * * *